US010753573B2

(12) United States Patent
Itahana et al.

(10) Patent No.: US 10,753,573 B2
(45) Date of Patent: Aug. 25, 2020

(54) OPTICAL DEVICE AND LIGHTING DEVICE

(71) Applicant: NICHIA CORPORATION, Anan-shi, Tokushima (JP)

(72) Inventors: Hiroyuki Itahana, Okaya (JP); Akira Nagahashi, Okaya (JP)

(73) Assignee: NICHIA CORPORATION, Anan-Shi (JP)

( * ) Notice: Subject to any disclaimer, the term of this patent is extended or adjusted under 35 U.S.C. 154(b) by 0 days.

(21) Appl. No.: 16/670,415

(22) Filed: Oct. 31, 2019

(65) Prior Publication Data

US 2020/0149708 A1 May 14, 2020

(30) Foreign Application Priority Data

Nov. 9, 2018 (JP) ..... 2018-211667

(51) Int. Cl.

| | |
|---|---|
| ***F21V 7/04*** | (2006.01) |
| ***F21V 7/10*** | (2006.01) |
| ***F21Y 115/10*** | (2016.01) |
| ***F21V 29/70*** | (2015.01) |

(52) U.S. Cl.

CPC ..... *F21V 7/041* (2013.01); *F21V 7/10* (2013.01); *F21V 29/70* (2015.01); *F21Y 2115/10* (2016.08)

(58) Field of Classification Search

CPC . F21V 7/041; F21V 29/70; F21V 7/10; F21Y 2115/10

See application file for complete search history.

(56) References Cited

U.S. PATENT DOCUMENTS

| | | | | |
|---|---|---|---|---|
| 6,646,813 | B2 * | 11/2003 | Falicoff | G02B 6/0035 359/641 |
| 7,934,851 | B1 * | 5/2011 | Boissevain | F21S 8/088 362/241 |
| 10,436,970 | B2 * | 10/2019 | Durkee | G02B 6/0063 |
| 2005/0110649 | A1 * | 5/2005 | Fredericks | B64D 47/06 340/815.45 |
| 2006/0147151 | A1 * | 7/2006 | Wanninger | F21S 43/247 385/31 |
| 2010/0220492 | A1 * | 9/2010 | Richardson | G02B 6/0075 362/551 |

FOREIGN PATENT DOCUMENTS

| | | |
|---|---|---|
| CN | 204647968 U | 9/2015 |
| JP | 2012-028254 A | 2/2012 |
| JP | 2012-074278 A | 4/2012 |
| JP | 2014-160581 A | 9/2014 |

* cited by examiner

*Primary Examiner* — Tsion Tumebo
(74) *Attorney, Agent, or Firm* — Foley & Lardner LLP

(57) ABSTRACT

An optical device includes: a plurality of walls disposed to meet along a first axis and having reflecting surfaces facing a space interposed between the walls; and a plurality of partitions, each having a funnel-like shape and each having an outer surface that includes a curved reflecting surface, the partitions disposed in the space interposed between the walls coaxially with the first axis at multiple levels along the first axis; wherein the outer surface of a first of the partitions located at an upper level is configured to receive at least some light through an opening of a second of the partitions located at lower level.

12 Claims, 8 Drawing Sheets

OPTICAL DEVICE AND LIGHTING DEVICE

CROSS-REFERENCE TO RELATED APPLICATION

This application claims priority to Japanese Patent Application No. 2018-211667, filed on Nov. 9, 2018, the disclosure of which is hereby incorporated by reference in its entirety.

BACKGROUND

The present disclosure relates to an optical device suited for illuminating a linear or quadrangular area, and a lighting device using the same.

Japanese Patent Publication No. 2012-074278 discloses a lighting device capable of achieving a long linear irradiation range using a small number of light source modules. The lighting device disclosed in this patent publication is equipped with light source units arranged in two rows, four units per row. Each light source unit comprises a set of light source modules. Each light source module distributes the divergent beams of light from the light emitting element into first outgoing light forward of the substrate via the light source lens and second outgoing light forward of the substrate after being refracted by the light source lens and reflected by the second reflectors. In each light source unit, two light source modules are disposed back to back so that their substrates form an acute angle, allowing the light source unit to spread the light at the angle formed by the substrate of one of the light source modules and the substrate of the other light source module to thereby produce linear illumination light having a constant width. The lighting device can thus achieve a long linear irradiation range.

SUMMARY

Light emitted by an LED basically has a Lambertian light distribution that is a light distribution pattern in which luminous intensity is highest (i.e., maximum) along the optical axis. Accordingly, in order to illuminate a long linear irradiation area using a few or centralized lighting devices, the light distribution must be controlled for a large number of LEDs arranged in a centralized location by changing numerous optical axis angles to disperse light along the line to be illuminated, or applying various complex processing to the light illuminating at the edges of the line and the light illuminating the center of the line relative to the optical axes set to intersect the line at an angle. For this reason, there is a need for an optical device capable of easily converting a Lambertian light distribution into a linear or quadrangular light distribution.

According to one embodiment of the present disclosure, an optical device includes walls and partitions. The walls are disposed to meet along a first axis, and have reflecting surfaces facing a space interposed between the walls. The partitions each have a funnel shape, and each have curved reflecting surface on the outer surface. The partitions are disposed in the space interposed between the walls coaxially with the first axis at multiple levels along the first axis. Light is incident on the outer surface of one of the partitions located at upper level through the openings of other one of the partitions located at lower levels.

According to another embodiment of the present disclosure, a lighting device includes the optical device described above and a light source disposed adjacent to the first axis on a lower side of a lowermost one of the partitions. The light source outputs light along the first axis.

The optical device according to certain embodiments of the present disclosure can output the light entering along the first axis after converting the Lambertian light distribution into a linear or quadrangular light distribution approximating a uniform luminous intensity distribution by utilizing the curved reflecting surfaces of the plurality of funnel-like partitions disposed at multiple levels around the first axis and the reflecting surfaces disposed to interpose the curved reflecting surfaces.

DETAILED DESCRIPTION

Figure 1:
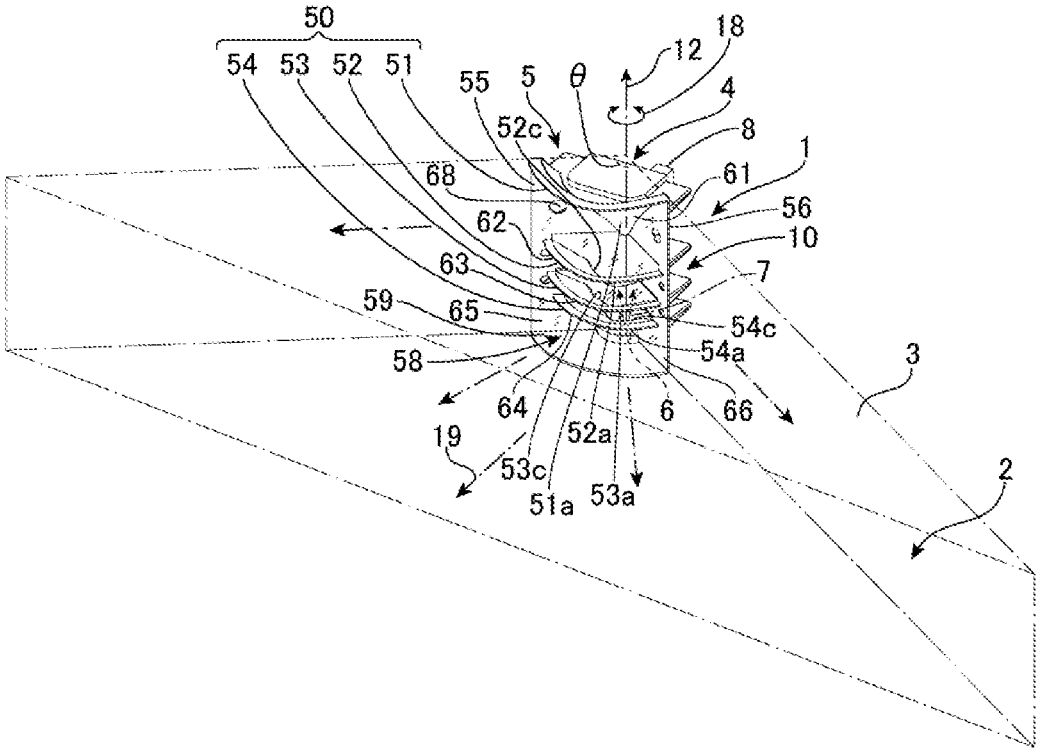
FIG. 1 is a perspective view of an example of a lighting device.

FIG. 1 shows one example of the lighting device according to the present disclosure. The lighting device 1 includes a projection unit 5 that projects forward 19 the light (i.e., luminous flux) 3 controlled to illuminate a quadrangular or linear area 2 such as a table top, a frame (i.e., housing) 4 that supports the projection unit 5, and a driver circuit 8 driving an LED 6 that is the light source of the projection unit 5. The projection unit 5 includes an optical device (i.e., optical system) 10 that includes a multileveled reflecting member 50 having a sector-like shape in a plan view (i.e., the shape when viewed in an X-Y plane intersecting Z axis 12) spreading around 18 the central axis (i.e., first axis or Z axis) 12 in an arc, and an LED 6 that provides the source light (i.e., first light) entering from the lower side of the lowermost member 54 of the multileveled reflecting member 50. When installed on a ceiling or the like, the lighting device 1 can illuminate a quadrangular area such as a table top, or a long narrow linear area 2 in a concentrated manner. The area to be illuminated does not have to be a table top, so long as it is a quadrangular or narrowly elongated area, and may be a wall, outdoor signboard or poster. The lighting device 1 can illuminate such a quadrangular or linear area 2 in a concentrated manner.

Figure 2:
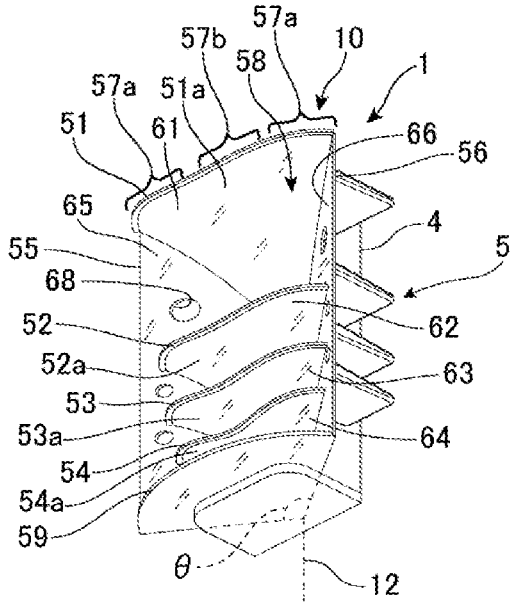
FIG. 2 is a diagram of the lighting device when viewed from a different angle.
Figure 3:
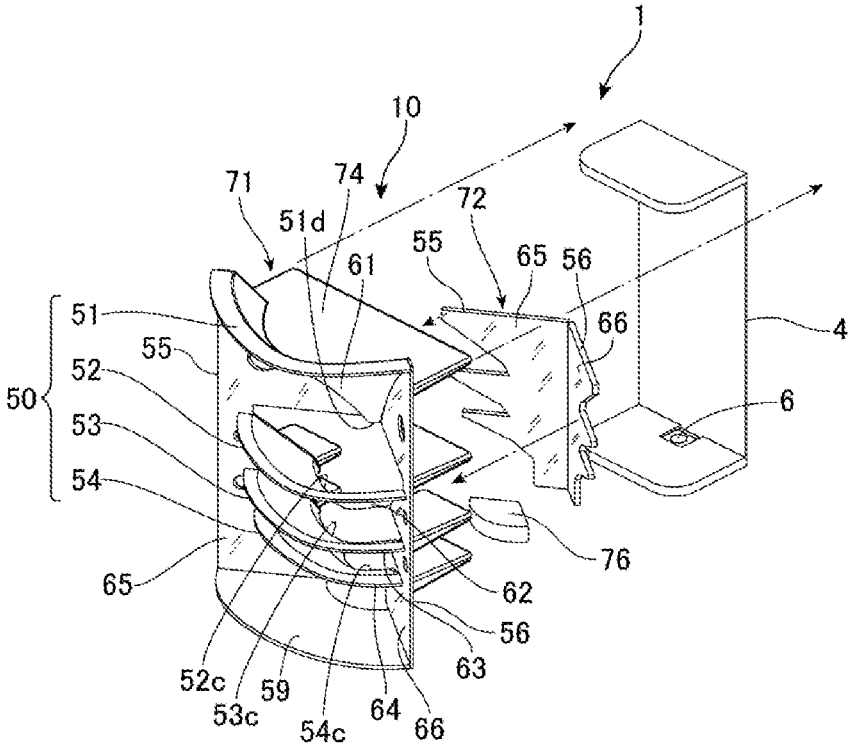
FIG. 3 is an exploded view of the lighting device.

FIG. 2 shows the lighting device 1 when viewed from the lower side. FIG. 3 is an exploded view of the lighting device 1. The optical device 10 includes walls 55 and 56 disposed to meet along a first axis (i.e., Z axis) 12, a plurality of funnel-like partitions 51, 52, 53 and 54 disposed in the space 58 interposed between the walls 55 and 56, coaxially with the first axis 12 at multiple levels along the first axis 12, and a bottom plate 59. The walls 55 and 56 include reflecting surfaces 65 and 66 facing the space 58 interposed between the walls. In this example, the inner surfaces of the walls (i.e., partitions) 55 and 56, in other words, the surfaces facing the space 58, are the reflecting surfaces 65 and 66 except for the openings 68 created in the walls 55 and 56. The funnel-like partitions 51 to 54 have outer surfaces 51*a* 52*a*, 53*a*, and 54*a* that includes curved reflecting surfaces 61, 62, 63 and 64, forming a multileveled reflecting member 50. In this example, the outer surfaces 51*a* to 54*a* of the partitions 51 to 54 are respectively the curved reflecting surfaces 61 to 64 in their entirety.

The funnel-like partitions 51 to 54 are thin sheets, each having a shape viewed in a plane orthogonal to the Z axis 12 (i.e., X-Y plane) and a shape in a sectional view taken in the direction orthogonal to the Z axis 12, in such a way that each of the outer surfaces 51*a* to 54*a* is a sector spreading around the Z axis 12, which is the central axis, at an angle θ of the central angle θ or the opening angle θ. The sectional view taken along the Z axis 12 is such that each of the outer surfaces 51*a* to 54*a* is a non-conical surface (i.e., non-symmetric conical surface) or free curved surface forming a parabola, hyperbola, or one approximating these. The lowermost part 51*d* of the uppermost partition 51 reaches the Z axis 12 and is closed, whereas the lowermost parts of the other partitions 52 to 54 are distant from the Z axis 12, creating openings 52*c* to 54*c*. Accordingly, the source light 7 emitted from the light source (LED) 6 is incident on the outer surfaces 51*a* to 53*a* of the upper level partitions 51 to 53 via the openings 52*c* to 54*c* of the lower level partitions 52 to 54 to be reflected by the curved reflecting surfaces 61 to 63 and output forward (in the radial direction) 19. The curved reflecting surface 64 provided on the outer surface 54*a* of the lowermost partition 54 reflects and outputs forward 19 the light component of the source light 7 having a large divergence angle (light distribution angle) ϕ.

Each of the outer surfaces 51*a* to 54*a* of the partitions 51 to 54 is, more specifically, a non-conical surface in which the radius of curvature of the inner portion 57*b* is larger than the radii of curvature of the outer portions 57*a* that are adjacent to the walls 55 and 56. The source light 7 entering along the Z axis 12 is reflected by the reflecting surfaces 65 and 66 of the walls 55 and 56 disposed to interpose the Z axis 12 to travel towards the space 58 interposed between the reflecting surfaces 65 and 66. Accordingly, the intensity of light at the outer portions 57*a* near the walls 55 and 56 is higher than at the inner portion 57*b* because of the light components of the light reflected by the reflecting surfaces 65 and 66. Thus, the radii of curvature are varied between the outer portions 57*a* and the inner portion 57*b* in each of the outer surfaces 51*a* to 54*a* of the partitions 51 to 54, which change the direction of the source light 7 before being output, to thereby produce light (i.e., luminous flux) 3 that illuminates the area 2 with more uniform intensity (i.e., luminance).

The partitions 51 to 54 and the walls 55 and 56 may be formed using a metal material, or an organic or inorganic material having a reflecting film formed on the surfaces. The reflecting film may be formed using a metal or a material that has reflecting properties on its own formed by vapor deposition or the like. The reflecting film may be a stack of multiple thin films having different refractive indices designed to achieve prescribed reflecting properties, or of any other structure to achieve prescribed reflecting properties. The reflectances of the curved reflecting surfaces 61 to 64 and the reflecting surfaces 65 and 66 can be selected in accordance with the application of the lighting device 1 or the like, and may be specular reflection or diffuse reflection.

The optical device 10 has high heat dissipation efficiency because the reflecting surfaces 65, 66 and the curved reflecting surfaces 61 to 64 are configured with thin walls 55, 56 and thin partitions 51 to 54, thereby attenuating temperature increase in the optical device 10 and the lighting device 1. In order to further increase the heat dissipation efficiency, the walls 55, 56 and the partitions 51 to 54 may be formed of a material that has a thermal conductivity of about 10 W/(m·K) or higher. The walls 55, 56 and the partitions 51 to 54 may be formed of a metal, such as stainless steel and aluminum, a ceramic material or a resin containing fillers such as carbon material, silicon or high-thermal-conductivity carbon nanotubes. The thermal conductivity may be at least 5 W/(m·K), at least 50 W/(m·K), or at least 100 W/(m·K). The thermal conductivity of certain materials having an extremely high thermal conductivity such as carbon nanotubes can reach about 2000 W/(m·K) to 5000 W/(m·K). In the case of a metal or carbon material, the thermal conductivity may be in a range from 100 W/(m·K) to 400 W/(m·K). An example of readily formable materials having a high thermal conductivity is a die cast material whose thermal conductivity is in a range from 100 W/(m·K) to 150 W/(m·K). Alternatively, any material having the thermal conductivity described above may be formed by plastic forming.

As shown in FIG. 3, the optical device 10 includes a molded member 71 in which at least some portions of the walls 55 and 56 and at least some portions of the partitions 51 to 54 are integrally formed. Specifically, the optical device includes a molded member 71 and a molded member 72. In the molded member 71, at least some portions of the walls 55 and 56 and the partitions 51 to 54 are integrally formed. In the molded member 72, the remaining portions of the walls 55 and 56 are integrally formed. The lighting device 1 is assembled by installing these molded members 71, 72 on a frame 4 that includes an LED 6 disposed at the bottom surface. A transparent cover 76 is further attached to the LED 6.

Figure 4A:
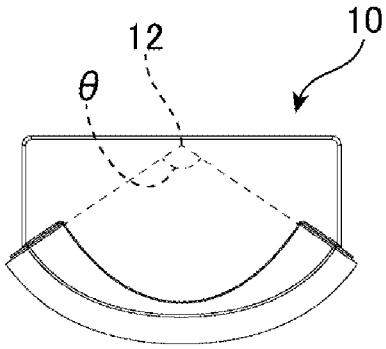
FIG. 4A is a plan view of a structure of the molded member of an optical device.
Figure 4B:
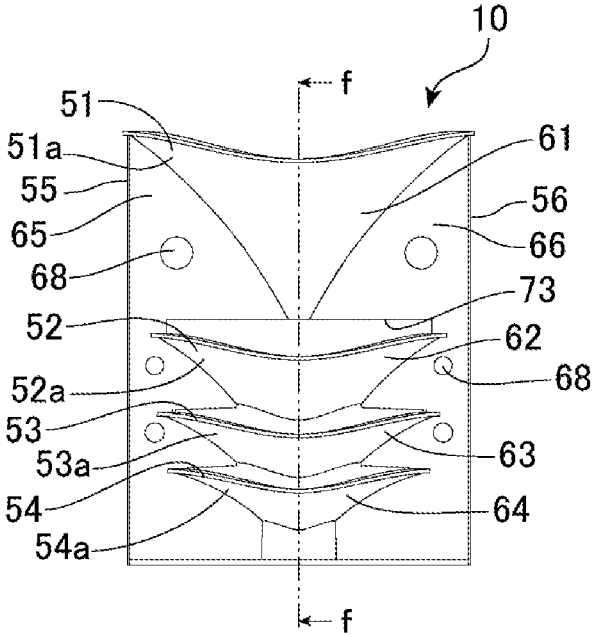
FIG. 4B is a front view of the structure of the molded member of the optical device shown in FIG. 4A.
Figure 4C:
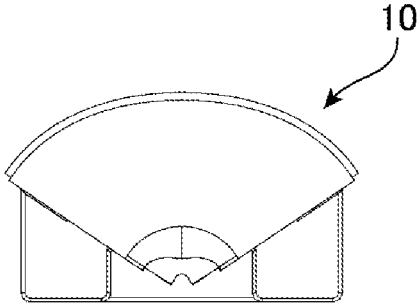
FIG. 4C is a bottom view of the structure of the molded member of the optical device shown in FIG. 4A.
Figure 4D:
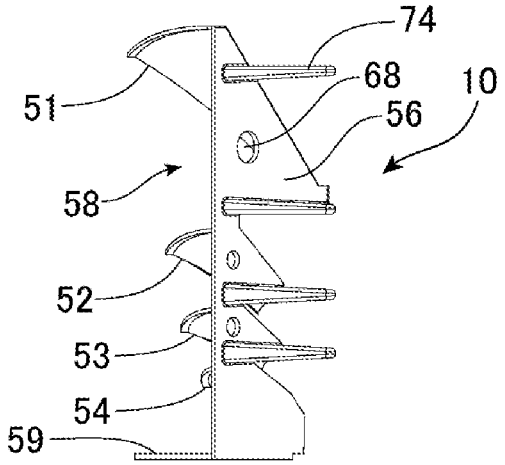
FIG. 4D is a right-side view of the structure of the molded member of the optical device shown in FIG. 4A.
Figure 4E:
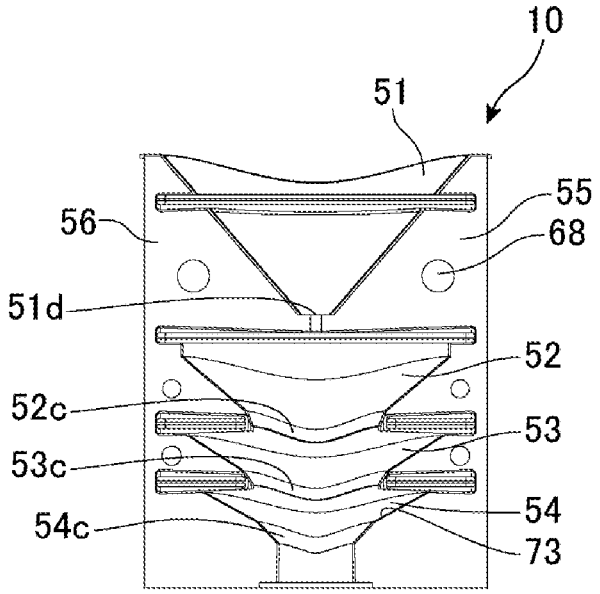
FIG. 4E is a rear view of the structure of the molded member of the optical device shown in FIG. 4A.
Figure 4F:
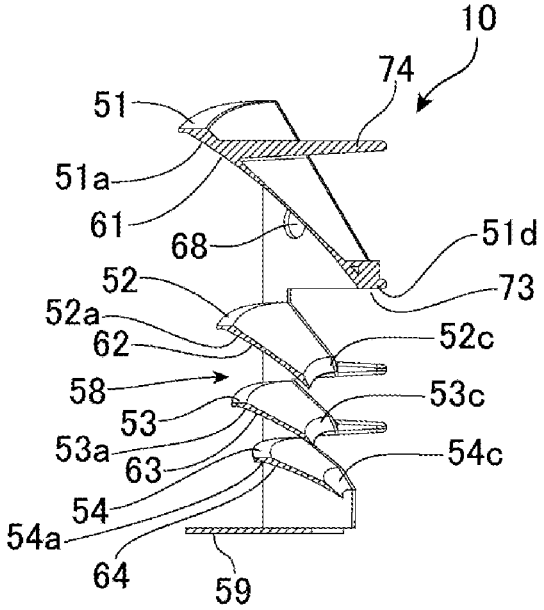
FIG. 4F is a sectional view of the structure of the molded member of the optical device shown in FIG. 4A.

FIG. 4 includes various diagrams showing the molded member 71 in a plan view of FIG. 4A, in a front view of FIG. 4B, in a bottom view of FIG. 4C, in a right-side view of FIG. 4D, in a rear view of FIG. 4E, and in a sectional view of FIG. 4F viewed from the right side that includes the Z axis 12. The left-side view is symmetrical to the right-side view. For reasons attributable to the molding die, open portions 73 are created in the rear side along the Z axis of the walls 55 and 56 that oppose the lower level partitions 52 to 54. That is, the open portions 73 are created in portions excluding the uppermost partition 51. The open portions 73 of the walls 55 and 56 are closed by being combined with the molded member 72, thereby providing the reflecting surfaces 65 and 66 on both sides of the Z axis as a whole. Moreover, openings 68 are intermittently created in the walls 55 and 56 of the molded member 71 for facilitating ventilation in the space 58 that is interposed between the walls 55 and 56 to thereby attenuate temperature increase in the space 58. A plurality of supports 74 are intermittently provided up and down on the rear surface of the molded member 71 to be attached to the U-shaped frame 4 so as to align the molded member 71.

Figure 5:
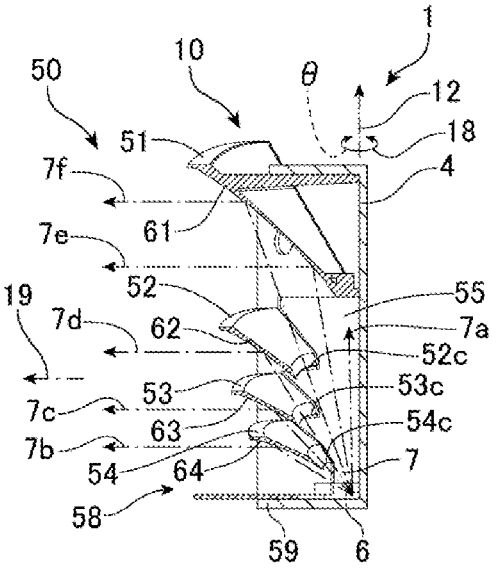
FIG. 5 is a schematic view of the optical device showing how the incident light is reflected by the curved reflecting surfaces.
Figure 6:
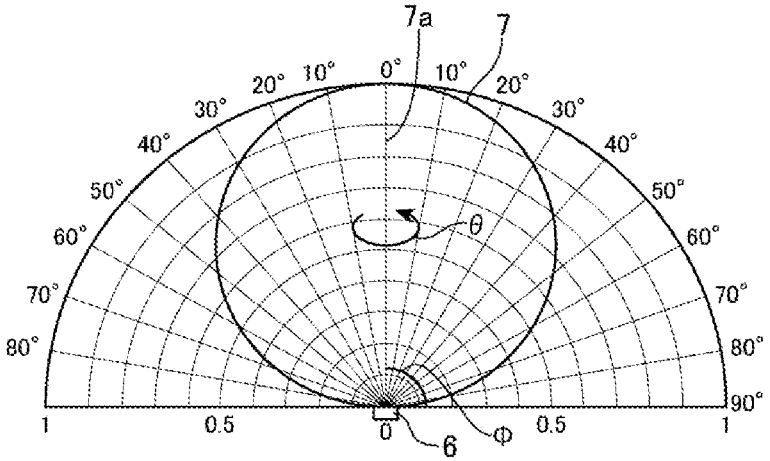
FIG. 6 is a chart showing an example of the light distribution of incident light.

FIG. 5 schematically shows how the light (e.g., incident light and source light) 7 entering along the Z axis 12 is output in the direction 19 which is orthogonal to the Z axis 12 by the multileveled reflecting member 50 of the optical device 10. As shown in FIG. 6, the light 7 output by the LED (i.e., light source) 6 has a Lambertian light distribution whose center is the optical axis 7*a*. The light component of the light 7 around the optical axis 7*a* are reflected by the reflecting surfaces 65 and 66, which are joined along the Z axis 12 at an angle θ, towards the sector-shaped space 58 having the central angle θ. The light components of the light 7 defined by the light distribution angle ϕ relative to the optical axis 7*a* are divided by the multiple (i.e., multi-leveled) curved reflecting surfaces 61 to 64 into multiple groups (i.e., optical fluxes), as shown in FIG. 5, to be respectively output (i.e., reflected) in the direction 19 orthogonal to the optical axis 7*a*.

In other words, in the lighting device 1 having an optical device 10, and a light source (LED) 6 disposed adjacent to the Z-axis on the lower side of the lowermost partition 54 of the multileveled partitions 51 to 54 for outputting light 7 along the Z axis 12, the light 7 from the LED 6 emitted along the Z axis 12 is reciprocally reflected, in other words, folded in by the reflecting surfaces 65 and 66, which meet the Z axis 12 at a central angle θ, towards the multileveled curved reflecting surfaces 61 to 64 in the range (i.e., space) defined by the angle θ. The optical device 10 allows the multileveled curved reflecting surfaces 61 to 64 to reflect and output light in the direction perpendicular to the Z axis 12 in the range defined by the angle θ about the Z axis 12. It suffices to provide the reflecting surfaces 65 and 66 so as to reciprocally reflect the light 7 from the LED 6 in the range defined by the angle θ, suffices to be disposed at least in the vicinity of the LED 6. The small reduction in the reflecting areas attributed to the openings 68 would have less impact on the intensity of light being output by the curved reflecting surfaces 61 to 64. Considering the amount of ventilation achieved by a single or multiple openings 68, the ratio of the area So accounting for the openings 68 to the area Sr accounting for the intended reflecting surfaces 65 and 66 may be in a range of 1 to 20%, at least 2%, at least 3%, or 10% at most.

Each of the multileveled curved reflecting surfaces 61 to 64 includes an arc-shaped reflecting surface that spreads while slanting along the Z axis at an acute angle relative to a plane orthogonal to the Z axis 12 (i.e., X-Y plane). The light component 7*b* of the light 7 output by the LED 6 having a large light distribution angle ϕ is output in the direction 19 orthogonal to the optical axis 7*a* by the lowermost curved reflecting surface 64. A portion of the light component 7*c* of the source light 7 having a smaller light distribution angle ϕ than that of the light component 7*b* and passing through the opening 54*c* at the bottom of the funnel-like partition 54 forming the lowermost curved reflecting surface 64 is output in the direction 19 orthogonal to the optical axis 7*a* by the curved reflecting surface 63 that is located one level above. A portion of the light component 7*d* of the source light 7 having a smaller light distribution angle ϕ than that of the light component 7*c* and passing through the opening 53*c* at the bottom of the funnel-like partition 53 forming the curved reflecting surface 63 is output in the direction 19 orthogonal to the optical axis 7*a* by the curved reflecting surface 62 that is located one level above. The light components 7*e* and 7*f* having a smaller light distribution angle ϕ than that of the light component 7*d* and passing through the opening 52*c* at the bottom of the funnel-like partition 52 forming the curved reflecting surface 62 are output in the direction 19 orthogonal to the optical axis 7*a* by the uppermost curved reflecting surface 61.

Accordingly, the optical device 10 can convert the light 7 having a Lambertian light distribution into illumination light 3 having a light distribution suited for illuminating a linear or quadrangular area through arc-shaped reflection to output light in the direction 19 orthogonal to the optical axis 7*a* by using the curved reflecting surfaces 61 to 64 and the reflecting surfaces 65 and 66. The multileveled curved reflecting surfaces 61 to 64 reflect and change the direction of the light 7 to the direction 19 orthogonal to the optical axis 7*a*. Accordingly, with this optical device, a portion of a light distribution angle ϕ around the optical axis 7*a* in the Lambertian distribution, that has the common luminous intensity in the Lambertian distribution having an intensity variations depending on the light distribution angle ϕ, is extended from one end to the other end of a linear or quadrangular light distribution. For example, the optical device can extend the light (e.g., luminous flux) on the optical axis 7*a* having the highest luminous intensity from one end to the other end of a linear or quadrangular light distribution. Furthermore, the luminous intensity in the width direction of a linear or quadrangular shape can be controlled by controlling the curvature or slant of the multileveled curved reflecting surfaces. This can achieve a linear or quadrangular light distribution that is even closer to uniform distribution. Although this example employs four levels of curved reflecting surfaces 61 to 64, the number of curved reflecting surfaces does not have to be four levels. It may be at three levels or less, or five levels or more.

Figure 7:
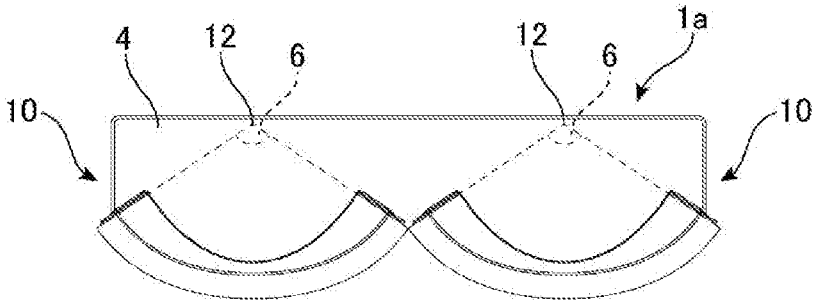
FIG. 7 is a diagram showing a different example of a lighting device.

FIG. 7 shows another example of the lighting device according to the present disclosure. The lighting device 1*a* includes multiple optical devices 10 and light sources 6, two each in this example, and the first axes (i.e., Z axes) 12 of the optical devices 10 are positioned apart from one another. The linear or quadrangular shaped light 3 achieved by each of the optical devices 10 can illuminate the same or overlapped area 2, thereby increasing the illuminance.

Figure 8:
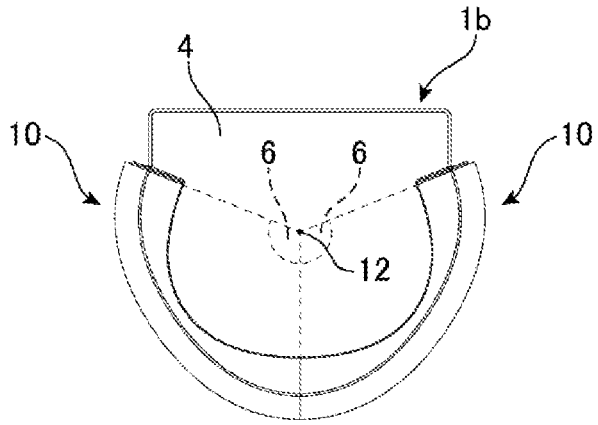
FIG. 8 is a diagram showing another example of a lighting device.

FIG. 8 shows another example of the lighting device according to the present disclosure. The lighting device 1*b* has multiple optical devices 10 and light sources 6, two each in this example, and the optical devices 10 are positioned so as to share a first axis (i.e., Z axis) 12 or such that their first axes are adjacent to one another. The linear or quadrangular shaped light 3 achieved by each of the optical devices 10 can illuminate two contiguous areas 2, thereby expanding the illuminated area.

Figure 9A:
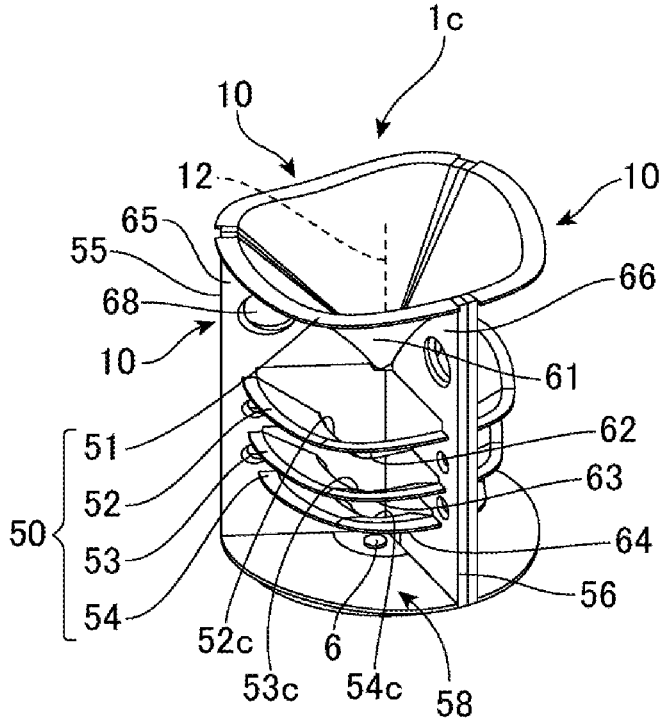
FIG. 9A is a perspective view of yet another example of a lighting device.
Figure 9B:
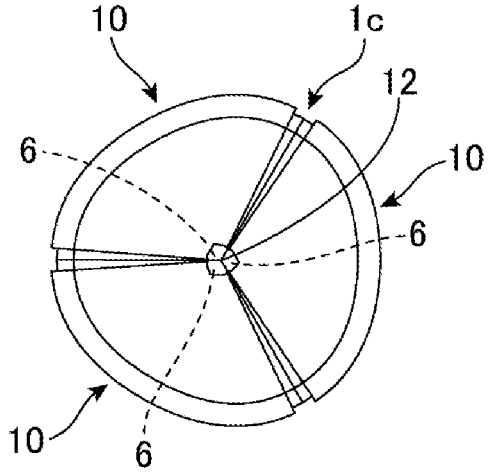
FIG. 9B is a plan view of the lighting device shown in FIG. 9A.
Figure 9C:
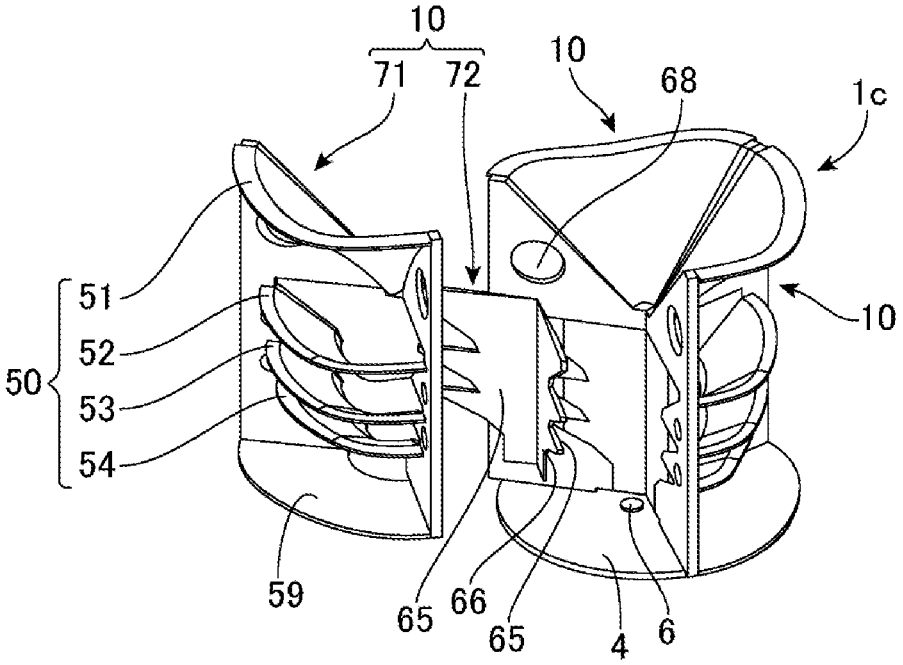
FIG. 9C is an exploded view of the lighting device shown in FIG. 9A.

FIGS. 9A to 9C each show another lighting device 1*c*. The lighting device 1*c* has three optical devices 10 and three light sources 6, and such members are arranged so as to share the Z axis 12 to illuminate a quadrangular area through 360 degrees. FIG. 9A is a perspective view of the lighting device 1*c*. FIG. 9B is a plan view of the lighting device 1*c* when viewed from above. FIG. 9C is an exploded view of the lighting device 1 showing the molded members 71 and 72. The molded member 72 that forms the walls 55 and 56 is shared by the adjacent optical devices 10, in other words, both surfaces of the walls 55 and 56 are reflecting surfaces 65 and 66. Alternatively, each of the three optical devices 10 may include a molded member 72.

As explained above, the lighting device 1 includes an optical device 10 that has reflecting surfaces 65, 66, and multileveled curved reflecting surfaces 61 to 64. The reflecting surfaces 65, 66 meet along the optical axis and reciprocally reflect light in intersecting directions. The multileveled curved reflecting surfaces 61 to 64 are disposed in the space 58 interposed between the reflecting surfaces 65 and 66, and have an arc-shaped cross section taken along the optical axis. Thus the lighting device 1 can output the light from the light source, LED 6, as a luminous flux 3 having substantially a quadrangular shape in the direction orthogonal to the optical axis. Using the optical device 10 can realize a lighting device 1 capable of efficiently and more uniformly converting the light 7 from the light source (LED) 6 into light having a linear or quadrangular light distribution, thereby more uniformly and brightly illuminating a linear or quadrangular area.

In the foregoing, optical devices 10 having four levels of curved reflecting surfaces 61 to 64 have been described as examples. The optical device, however, may have five or more levels of curved reflecting surfaces, or three or fewer levels of curved reflecting surfaces. The examples described above have a central angle (i.e., opening angle) θ of 110 degrees formed by the reflecting surfaces 65 and 66, which define a sector-like area, but the central angle θ may be smaller than 110 degrees, larger than 110 degrees, or at least 180 degrees. The number of LEDs 6 arranged as light sources is not required to be one, and plural LEDs of multiple colors may be arranged as light sources. Furthermore, it is not required to create an opening 68 in the reflecting surfaces 65 and 66. In the case of creating an opening 68, the opening 68 does not have to be a circular shape, and may be elliptical or quadrangular shape. Furthermore, there is no particular requirement for the quantity of openings 68.

What is claimed is:

1. An optical device comprising:

a plurality of walls disposed to meet along a first axis and having reflecting surfaces facing a space interposed between the walls; and a plurality of partitions, each having a funnel-like shape and each having an outer surface that includes a curved reflecting surface, the partitions disposed in the space interposed between the walls coaxially with the first axis at multiple levels along the first axis;

wherein the outer surface of a first of the partitions located at an upper level is configured to receive at least some light through an opening of a second of the partitions located at lower level.

2. The optical device according to claim 1, wherein the walls comprise a metal material, or an organic or inorganic material having a reflecting film formed on surface thereof.

3. The optical device according to claim 1, wherein the partitions comprise a metal material, or an organic or inorganic material having a reflecting film formed on surfaces thereof.

4. The optical device according to claim 1, wherein at least a portion of the walls and at least a portion of the partitions are integrally molded as part of a molded member.

5. The optical device according to claim 1, wherein a lowermost portion of the outer surface of the first of the partitions is closed.

6. The optical device according to claim 1, wherein at least one of the walls comprises a plurality of openings extending therethrough.

7. The optical device according to claim 1, wherein a thermal conductivity of the walls and the partitions is at least 5 W/(m·K).

8. The optical device according to claim 1, wherein at least one of the partitions includes outer portions that are adjacent to the walls, and an inner portion between the outer portions; and wherein the outer surfaces of the at least one of the partitions are non-conical surfaces in which a radius of curvature of the inner portion is larger than a radii of curvature of the outer portions.

9. A lighting device comprising:

the optical device according to claim 1; and a light source disposed adjacent to the first axis on a lower side of a lowermost one of the partitions, the light source configured to output light along the first axis.

10. The lighting device according to claim 9, further comprising an additional optical device and an additional light source, wherein the first axis of the optical devices is apart from the first axis of the additional optical device.

11. The lighting device according to claim 9 further comprising an additional optical device and an additional light source, wherein the first axes of the optical device and the additional optical device are adjacent to one another.

12. The lighting device according to claim 9 further comprising an additional optical device and an additional light source, wherein the optical device and the additional optical device share a first axis.

* * * * *